US009856121B2

(12) United States Patent
Bjørshol

(10) Patent No.: US 9,856,121 B2
(45) Date of Patent: Jan. 2, 2018

(54) CRANE STRUCTURE

(75) Inventor: Øyvind Bjørshol, Averøy (NO)

(73) Assignee: ROLLS-ROYCE MARINE AS, Brattvag (NO)

( * ) Notice: Subject to any disclaimer, the term of this patent is extended or adjusted under 35 U.S.C. 154(b) by 0 days.

(21) Appl. No.: 13/060,659

(22) PCT Filed: Aug. 25, 2009

(86) PCT No.: PCT/NO2009/000299

§ 371 (c)(1),
(2), (4) Date: May 23, 2011

(87) PCT Pub. No.: WO2010/024689

PCT Pub. Date: Mar. 4, 2010

(65) Prior Publication Data

US 2011/0210091 A1 Sep. 1, 2011

(30) Foreign Application Priority Data

Aug. 25, 2008 (NO) ..... 20083654

(51) Int. Cl.
*B66C 23/10* (2006.01)
*B66C 23/14* (2006.01)

(52) U.S. Cl.
CPC ..... *B66C 23/10* (2013.01)

(58) Field of Classification Search
CPC ..... B66C 23/10
USPC ..... 212/294, 299, 300, 223, 232, 237, 238, 212/245, 255, 256, 260, 261, 271, 71, 76; 414/685, 722; 37/403, 395, 468
See application file for complete search history.

(56) References Cited

U.S. PATENT DOCUMENTS

| | | | | |
|---|---|---|---|---|
| 2,831,589 A * | 4/1958 | Way | 414/735 |
| 3,298,539 A * | 1/1967 | Sundstrom | 212/288 |
| 3,630,389 A | 12/1971 | Schmidt et al. | |
| 3,884,359 A * | 5/1975 | Suverkrop | 212/289 |
| 3,995,746 A | 12/1976 | Usagida | |
| 2008/0121603 A1* | 5/2008 | Leinonen | 212/300 |

FOREIGN PATENT DOCUMENTS

| | | |
|---|---|---|
| DE | 3602912 | 10/1986 |
| GB | 2065597 | 7/1981 |
| JP | 2007203221 A * | 8/2007 |
| NL | 7410091 | 1/1975 |
| WO | WO 2006/090015 | 8/2006 |

OTHER PUBLICATIONS

International Search Report, PCT/NO2009/000299, dated Dec. 21, 2009.
International Preliminary Report on Patentability (IPRP), dated Feb. 15, 2011.

* cited by examiner

*Primary Examiner* — Sang Kim
*Assistant Examiner* — Juan Campos, Jr.
(74) *Attorney, Agent, or Firm* — Abelman, Frayne & Schwab

(57) ABSTRACT

A crane characterized in that it comprises a lower vertical boom (10) and an upper horizontal boom (12), mutually connected through a joint element (20), in that the lowest part of the vertical boom is connected through a pedestal (14), the pedestal further comprising a slew ring for rotating of the crane about a vertical axis (16), and a tension rod (22) is arranged between the pedestal and the joint element in a distance from the vertical boom and mainly parallel to this in a normal position of the crane.

9 Claims, 3 Drawing Sheets

CRANE STRUCTURE

RELATED CASES

Figure 1A:
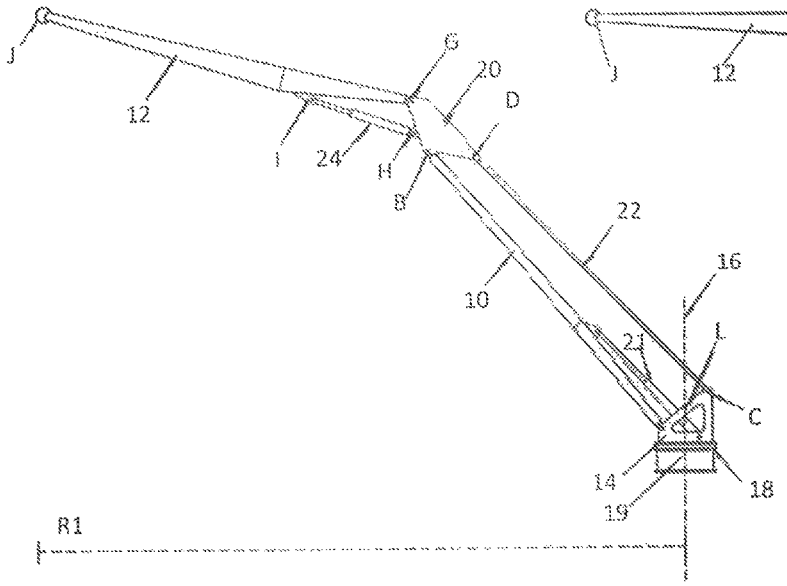

This application claims priority on PCT/NO09/000,299 filed on 25 Aug. 2009 and Norway Application No. 20083654 filed on 25 Aug. 2008.

The present invention relates to an arrangement for a crane as indicated in the preamble of the following claim 1.

There is a disadvantage in existing crane structures with fixed boom, bending boom and telescopic boom in that the load is raised or lowered in response to radial movements. In order to move the crane boom horizontally, i.e. when a load is to be positioned horizontally, several movements must be combined, or adjustment must be made by hoisting or slackening at the winch.

As concerns the prior art, reference will be made to what is known from DE 3,602,912, U.S. Pat. No. 3,884,359, Dutch publication NL-7410091 and GB patent 2,065,597.

The patent first mentioned discloses a lifting arrangement comprising a lower boom and an upper boom, which are connected with each other by way of an articulated piece. The lower boom is arranged pivoting in a swivel head for rotation of the cranes about a vertical axis. Hydraulic cylinders are used for control of the respective booms. A tension member is mounted between the articulated piece and the upper end of a swivel head element.

Objects of the Invention

It is an object of the invention to provide a crane construction which employs substantial movement from smallest to largest radius, outwardly from a central point.

It is an object of the invention to provide a crane construction enabling an approximately horizontal movement of the load over a complete working region, wherein vertical movement of the load is achieved with help of a winch.

It is therefore an object of the invention to provide a construction operating so that when the assembly of a vertical boom and a stay member is pivoted about a horizontal axis, a wire pulley at the end of the horizontal boom of the crane moves mainly along a straight line.

The Invention

The crane structure of the invention is characterized by the features appearing in the following independent patent claim 1. Preferred embodiments are defined in the independent claims.

The crane structure is characterized in that it comprises a lower boom 10 and an upper horizontal boom 12 of predetermined length L which are mutually connected via an articulated member 20. The boom 10 is at its bottom connected to a "crown" 14, which in turn comprises a swivel head for use in rotating the crane about a vertical axis 16, and a stay member 22 is arranged between the "crown" and the articulated member 20 at some distance from the boom 10 and substantially parallel with the latter in a normal position (vertical) of the crane.

Preferably, the stay member 22 is mounted on the "crown" at another level of height relative to the vertical boom 10.

Preferably, the "crown" as seen in a side section, forms an approximately triangular design, in that a line L between the vertical boom (10) and the articulated member 20 (points A and C) mutually form an angle in a range of 30° to 60°, namely of about 45°.

Preferably the articulated member 20 is a triangular structure, in which (in the normal position of the crane, FIG. 1B) the vertical boom 10 and the stay member 22 respectively, are attached swivelingly or pivotably and spaced apart at substantially the same level of height.

Preferably the vertical boom 10, the horizontal boom 12 and the stay member 22 respectively are supported at respective corners B-D-G in the articulated member.

Preferably the stay member 22 is shorter than the vertical boom 10.

Compared to the state of art as represented by the aforementioned German patent DE-3.602.912, the following differences are pointed out in respect of the present invention.

According to the German patent, the wire runs over a curved pulley, whereas in the present invention a stay member 22 is used and connected to a point in an articulated element.

According to the German patent DE-3.602.912, the wire operates with a constant working radius, (the distance from a wire 9 to an axis 6, according to the figure), whilst the stay member 22 will have a variable working radius (the distance from the stay member 22 to point B in the aforementioned solution, see the figure which is discussed later).

In the forward and rear positions of the crane, this radius will be smaller, and will be largest in its intermediate position. The reduction of the working radius results in the horizontal boom 12 being lifted to an extra degree, and in this manner compensates for the difference in height that arise during the pivot movement.

In the German patent DE-3.602.912, the pulley disc 7 and the loading arm 8 are disposed in a common axis 6 on the top of the outer assembly 3 (see the figure in the German patent). In the present construction the boom 12 is coupled to an axis G on the articulated member 20 and therefore does not have a common axis with the articulated member 20 which rotates about the axis B on the top of the vertical boom 10.

It will be appreciated from the figures as discussed in the following that the anchoring points between the crown, the vertical boom 10, the articulated member 20 and the stay member 22 forms a rectangle with corners A, B, C, D. The decisive feature for the crane to be able to maintain a constant height for the wire pulley J, relates to the geometry of this quadrangle. First and most the position that arises between positions A and C on the crown, and especially the angle they form in relation to the horizontal plane.

Secondly it relates to the relationship between the length of the vertical boom (A-B), the length of the stay elements (C-D), the distance (B-D) of the stay element and the distance (A-C) on the crown.

Figure 2:
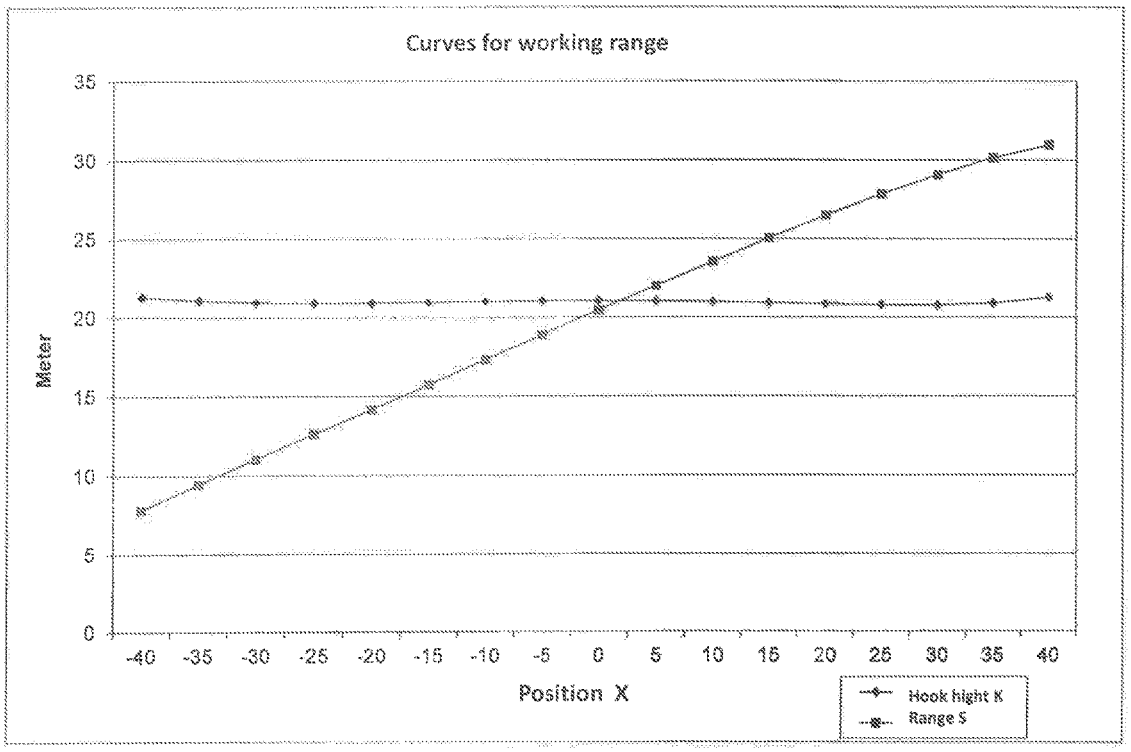

By adapting this geometry in a correct manner as described above and shown in the drawing figure, it is possible to achieve a result that the wire pulley J moves in a direct line (+/−2%) during the pivot actuation, for example pursuant to the curve shown in FIG. 2. It is also possible to define whether the lifting height is to rise or fall with increasing working radius, namely defining a slope of the straight line.

PRACTICAL PREFERRED EMBODIMENTS

The figures will now be referred to which show various cross-sections of a crane construction pursuant to the present invention, and which when implemented, will meet the objects as elucidated above, namely that the apex J of the crane will maintain itself at substantially the same horizontal level over the entire operating range of the crane.

Figure 1B:
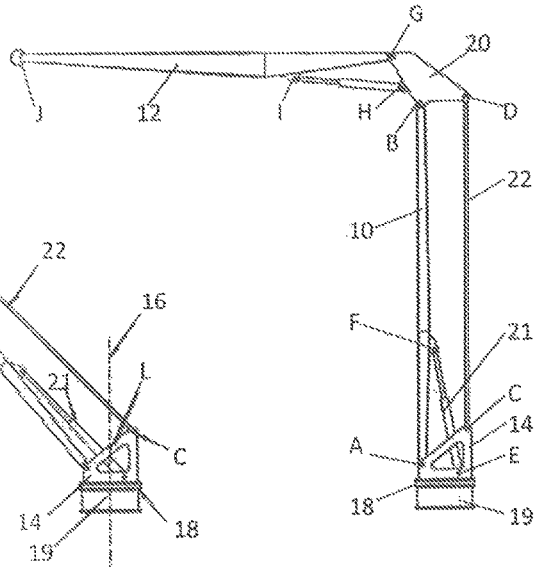
Figure 1E:
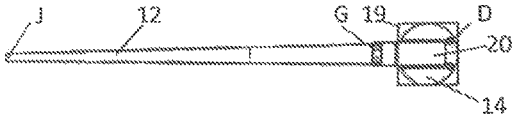
Figure 1C:
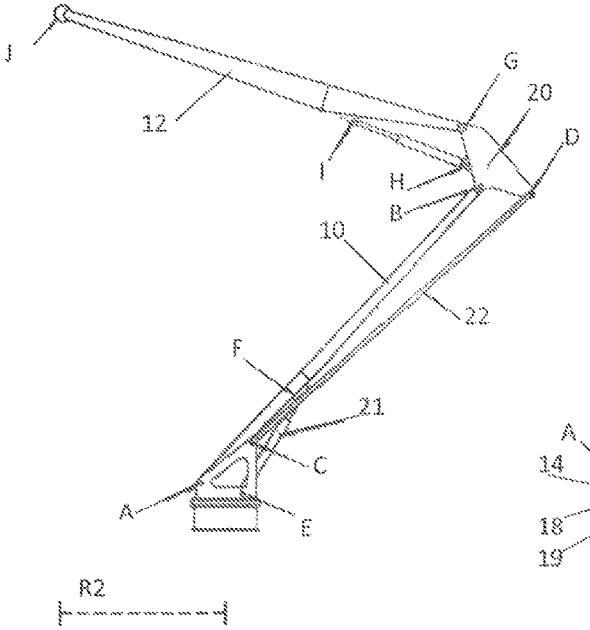
Figure 1D:
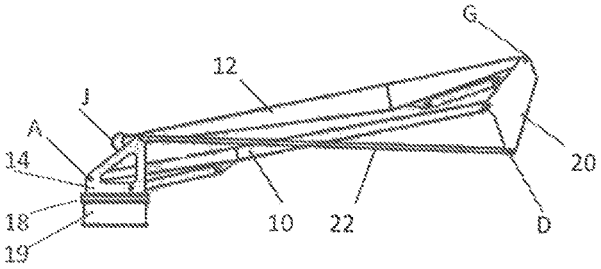

FIGS. 1A, 1B and 1C are illustrations of the crane pursuant to the invention in three positions, namely in its outer position (1A), in its normal position (1B) and in its inner position (1C). FIG. 1D shows a parking position wherein the booms are mutually folded together towards each other. FIG. 1E is a top plan view of the crane in FIG.1B.

FIG. 2 is an illustration of the height level of the horizontal boom (at the wire pulley J) in relation to the range of reach of the crane.

The figures provide the crane which is formed of two main parts, namely a vertical boom 10 and a horizontal boom 12. The vertical boom 10 is at its lower end coupled to a "crown" or socket component 14 which is operable to be turned about a vertical axis 16 on a bearing 18 at the top of the bottom socket or a swivel head 19. The vertical boom 10 is moveable with help of a tilting cylinder (alternatively in two pieces) 21 which are mounted between the point B on the crown 14 and the point F on the vertical boom 10. In the upper end of the vertical boom 10, there is disposed an articulated member 20 at the point E. The articulated member 20 can be, seen from a side view, a triangular construction. The horizontal boom 12 is coupled at the point G at a distance from the point E.

The articulated member 20 is held up and guided by way of a stay member 22 which is coupled at its lower end to the "crown" 14 at the point C, and to a lower end of the articulated member 20 at the point D. The figure provides an illustration of the "crown" 14 which has a triangular form, with horizontal and vertical leg, in that the skewed hypotenuse defines a line between points A and C on the crown, respectively. This hypotenuse subtends an angle of 45° with the horizontal. The stay member 22 is attached to the crown 14 in a point C which is at a higher horizontal level than the position whereat the horizontal boom 10 is attached to the crown 14 at the point A, which in consequence of the crown 14 defining the aforementioned angle 45°. As seen in the vertical boom 10 position as shown in FIG. 1B, the distance between the points A-C on the crown 14 is larger than the distance between the points B-D, and that the stay element 22 is somewhat shorter than the vertical boom 10. In this position, the stay element 22 and the vertical boom 10 are operable to be parallel.

The crane can rotate with help of the turning crown 18 on the foot 19 as is conventional.

The horizontal boom 12 is held up by assistance of a lifting cylinder 24 mounted between the point H on the articulated member 20 and the point I on the horizontal boom 12. At a distal end of the horizontal boom 12, there is attached a wire pulley J. This pulley guides a wire from the winch mounted onto or remote from the crane itself. As further seen in FIGS. 1A and 1B, lift cylinder 24 is pivotally coupled at its distal end to an intermediate point I on said upper boom 12, and at its proximal end to articulated member 20 intermediate points G and H on said articulated member, and as shown in this embodiment, to said articulated member along a straight line between points G and H.

According to a simpler embodiment of the invention, the lifting cylinder 24 can be omitted. The horizontal boom 12 and the articulated member 20 form a interconnected boom. Regulation of the height of the wire pulley J as described in the following paragraph is not possible, although the load can be lifted and lowered using the winch.

In a situation that the tilting cylinder and the lifting cylinder have sufficient operating length, the crane can be folded together in a more compact position as illustrated in FIG. 1D.

Manner of Operation

The crane moves itself between a largest radius R1 and a smallest radius R2 (reaching distance) by way of the vertical boom 10 moving forwards and backwards in relation to the vertical starting position, by way of assistance from the tilting cylinder 21. During such movement, the vertical boom 10 has as a main function to regulate the working radius of the crane. Thus, boom 10 is the lower boom, boom 12 is the upper boom, and boom 10 moves between rearward upward incline as seen in FIG. 1C, through a vertical position as seen in FIG. 1B, 2A forward upward incline position as seen in figure 1A. The horizontal boom 12 is operable to compensate for the height difference which arises (at point B) under this movement, such that the block (point J) is held at constant height. This occurs without the lifting cylinder being actuated, and in consequence the horizontal boom 12 follows movement of the articulated member 20. The stay member 22 steers this movement. By calculating optimal disposition of the points A, B, C and D, a compensation of movement is achieved which results in a substantially constant (horizontal) height for the wire pulley at point J. It is possible to achieve a height variation of approximately +/−2% of the radial movement.

By disposing the lifting cylinder 24 in another position, the height of the wire pulley J can be changed to approach a higher or lower position, simultaneously with it being possible to move the lifting moment closer to the centre of rotation of the crane.

This construction provides a series of advantages:

1: the boom cannot fall down. For a fall to occur, there must be a physical break in the steel construction of the crane. Loss of hydraulic power does not have any significance. In an event that the hydraulic cylinder is removed, the crane can continue to be moved horizontally.

2: the radial movement of the load is horizontal. This means that there is minimal force required for this horizontal movement, namely something which requires lower energy utilization as a consequence of employing a crane constructed pursuant to the present invention. Faster speed of operation is thereby possible in a similar manner to when the crane pivots around. This means that the load can be moved at high speed in all directions in a horizontal plane by way of rotation and radius adjustment.

3: adjustment of crane movement in operation becomes simpler and more logical. Every movement is controlled by its corresponding hydraulic function: rotation (adjustment of angle), reaching range (adjustment of radius), lifting (change in working height) and winch (raising and lowering of loads). The functions do not influence one another.

FIG. 2 is an illustration of how hook height (y-axis) in the horizontal boom 12 (at the wire pulley J) changes itself in relation to the crane's radial reaching distance or position (x-axis). As a result, the point J (wire pulley) holds itself stable at a height level of 21 to 22 metres over a given foundation level. As provided in the figures, the apex of the crane at point J is capable of a reaching range 40 metres to each side of the vertical axis 16. The position x=0 on the x-axis corresponds to the tip of the boom J intersecting the axis 16 (FIG. 1B).

The invention claimed is:

1. A crane having upright and other positions, comprising (a) a lower boom and a stay member, each having upper and lower ends, (b) a link plate having a generally triangular shape with three corners, where two of said corners are maintainable at a lower elevation than the elevation of the third corner, (c) a swivel head, (d) a crown having a generally triangular shape with three corners, with a line between two of said corners being the hypotenuse, and one leg of said crown oriented horizontally and fixedly mounted to said swivel head, (e) a hydraulic tilting cylinder having near and distal ends, (f) an upper boom having predetermined length and having near and distal ends, wherein i. said stay member is spaced apart from and is generally parallel to said lower boom during said upright position of said crane, ii. said upper ends of said lower boom and stay member are pivotally coupled to first and second of said to lower corners respectively of said link plate, and said upper boom's near end is pivotably coupled to said third of said corners of said link plate, and iii. said lower ends of said lower boom and stay member are respectively pivotably coupled to the hypotenuse corners of said crown, and said lower end of said hydraulic tilting cylinder is pivotally coupled to said swivel head and said upper end of said hydraulic tilting cylinder is pivotally coupled to said lower boom intermediate the upper and lower ends of said lower boom, and (g) a single lifting cylinder having near and distal ends, where said distal end of said lifting cylinder is pivotally coupled to said upper boom intermediate said upper boom's near and distal ends, and said lifting cylinder's near end is pivotally coupled to said link plate along a straight line intermediate the link plate's coupling points with said upper and lower booms, whereby said distal end of said upper boom is maintainable at substantially constant height.

2. The crane according to claim 1 wherein said stay member's lower end is attached to said crown at a higher vertical level than attachment of the lower end to said lower boom to said crown.

3. The crane according to claim 1 wherein said crown's hypotenuse extends at an angle of approximately 45° to the horizontal leg of said crown mounted to said swivel head.

4. The crane according to claim 1 wherein said stay member is shorter than the lower boom.

5. a crane having upright and other positions, comprising:

(a) a socket component, which in turn comprises a swivel head for rotation of said crane about a vertical axis, (b) a lower boom having upper and lower ends, (c) an upper boom having predetermined length and having near and distal ends, (d) an articulated member, (e) a hydraulic tilting cylinder having upper and lower ends, (f) a stay member which has upper and lower ends and is situated at a lateral distance from the lower boom and generally parallel with said lower boom in said upright position of said crane, said lower ends of said lower boom and of said stay member respectively coupled to said socket component, and said lower end of said hydraulic tilting cylinder pivotally coupled to said socket component, and said upper end of said hydraulic tilting cylinder pivotally coupled to said lower boom intermediate the upper and lower ends of said lower boom, where said articulated member is a generally triangular plate having three corners, where two of said corners are maintained at a lower elevation than the elevation of the third corner, and where said lower boom and said stay member have their upper ends pivotally coupled to said two lower position corners of said articulated member, and said upper boom's near and is pivotally coupled to said third and upper corner of said articulated member, and (g) a single lifting cylinder having near and distal ends with its near end of said lifting cylinder pivotally coupled to said articulated member between the two of said corners that are coupled to said upper end of said lower boom and to said near end of said upper boom respectively, and said distal end of said lifting cylinder pivotally coupled to said upper boom intermediate said upper and lower ends of said upper boom, (h) whereby said distal end of said upper boom is maintainable at substantially constant height while said tilting cylinder drives said lower boom and said stay member forward or backward.

6. The crane according to claim 5, wherein the lower end of said stay member is mounted on the socket component at a higher vertical level than that of the lower end of said lower boom.

7. The crane according to claim 5, wherein the socket component forms an approximately triangular design, a line between the connections of said lower boom and the stay member forming an angle of approximately 45° with the upper boom.

8. The crane according to claim 5, wherein in said upright position of the crane, said lower boom and the stay member are pivotably attached to said articulated member and are spaced apart and situated at substantially the same level of height in the articulated member.

9. The crane according to claim 5, wherein the stay member is shorter than said lower boom.

* * * * *